US006201478B1

(12) United States Patent
Hollis

(10) Patent No.: US 6,201,478 B1
(45) Date of Patent: Mar. 13, 2001

(54) SCUBA AIR DEVICE COMPUTER

(75) Inventor: Michael S. Hollis, Alameda, CA (US)

(73) Assignee: American Underwater Products Inc., San Leandro, CA (US)

( * ) Notice: Subject to any disclaimer, the term of this patent is extended or adjusted under 35 U.S.C. 154(b) by 0 days.

(21) Appl. No.: 09/321,672

(22) Filed: May 28, 1999

(51) Int. Cl.[7] ..... G08B 21/00
(52) U.S. Cl. ..... 340/626; 340/688
(58) Field of Search ..... 340/626, 688, 340/445; 73/865.1, 705; 128/201.27, 205.23, 205.24

(56) References Cited

U.S. PATENT DOCUMENTS

| | | | | |
|---|---|---|---|---|
| 4,004,272 | * | 1/1977 | Claxton et al. | 340/445 |
| 4,275,393 | * | 6/1981 | Johnston | 340/688 |
| 4,536,756 | | 8/1985 | DePasquale | 340/626 |
| 4,613,851 | | 9/1986 | Hines | 340/688 |
| 4,800,373 | | 1/1989 | Mayz | 340/626 |
| 4,882,678 | | 11/1989 | Hollis | 73/865.1 |
| 4,906,977 | | 3/1990 | Huey-Jeng | 340/626 |
| 5,051,729 | * | 9/1991 | Gray | 340/626 |
| 5,121,109 | | 6/1992 | Murphy | 340/688 |
| 5,156,055 | | 10/1992 | Hollis | 73/865.1 |
| 5,191,317 | | 3/1993 | Toth | 340/626 |
| 5,357,242 | | 10/1994 | Morgano | 340/688 |
| 5,457,284 | * | 10/1995 | Ferguson | 128/200.27 |
| 5,899,204 | * | 5/1999 | Cochran | 128/205.23 |

* cited by examiner

*Primary Examiner*—Van T. Trieu
(74) *Attorney, Agent, or Firm*—Bruce & McCoy

(57) ABSTRACT

A SCUBA air diver computer having an analog gauge with an IR switch mounted thereon which is actuated by a mirror attached to the pointer of the gauge to indicate a preselected pressure reading and actuate an aural alarm.

15 Claims, 2 Drawing Sheets

SCUBA AIR DEVICE COMPUTER

BACKGROUND OF THE INVENTION

1. Field of the Invention

The present invention relates to a method and apparatus for integrating SCUBA dive computers and air tank pressure indicators and for providing audible warnings for low tank pressures and transition into decompression zones. More particularly, it relates to aural signal generating apparatus and actuation thereof by analog gauges and computer programs.

2. Description of the Prior Art

There are numerous conditions which must be continuously and closely monitored by a SCUBA diver during a dive, including his depth, time underwater, air tank pressure, directional orientation, and, preferably, the continuous location of a dive partner. However, there are two particular conditions which can occur during a dive which are especially critical. The two conditions are low air pressure in the diver's tank and entry into a decompression zone during the dive.

Air tank pressure is most economically monitored with an analog air pressure gauge with acceptable accuracy and reliability for safety. Time and depth functions are now accurately measured by electronic dive computers which are programmed with sophisticated logic to monitor numerous parameters during a dive profile. Examples of such dive computers are disclosed in U.S. Pat. No. 4,882,678, issued Nov. 21, 1989, for a Data Sensing and Processing Device for SCUBA Divers, and U.S. Pat. No. 5,156,055, issued Oct. 20, 1992, for Ascent Rate Meter for SCUBA Divers, assigned to the assignee of the present invention. While the air pressure gauge and a dive computer are commonly arranged for carry in the same case, they have not been integrated until the present invention due to their structural incompatibility: one being mechanically driven and one being electronically actuated.

In the most ideal circumstances, the two described critical conditions would be monitored by a diver's support apparatus and automatically provide a more noticeable warning to a diver than simply the existence of a critical mark or reading on a dive gauge which is the case with either of the two types of prior art dive gauges. In an analog gauge, a pointer rotates on a dial face to point at a critical mark. In an electronic gauge, digital numbers provide a reading on the gauge face. While all dive gauges and computers are particularly directed to monitoring the two most critical conditions, there have been many attempts over time to integrate air pressure gauges and dive computers to improve the warning capability of the mechanisms, but generally they have been too expensive or for some reason unacceptable and have not improved on the basic independent apparatus.

A basic problem in attempting to provide a low air pressure warning is connected with characteristics of the analog air pressure gauge which indicates the air pressure in the diver's tank. It has proved very difficult to provide an analog gauge with an electrical signal generator indicating a preselected pressure in the tank. Expensive and complex apparatus can provide air pressure digital information which can be inputted to a computer, but that has not yet proven adaptable to SCUBA equipment. A reliable lightweight inexpensive small device is needed which will generate a signal to indicate a low pressure reading on an analog gauge. Until the present invention, this capability was not available.

A signaling means in addition to a critical mark or reading on a gauge face is also desired to provide a specialized warning in the event the diver does not observe the gauge pointing to the critical mark on the dial or a critical reading on the dive computer. Various means have been employed for this purpose, but generally they are very expensive or relatively ineffective. The present invention provides an integrated solution to these problems for both a low pressure air condition on an analog air pressure gauge or a decompression zone reading on a digital gauge. The history of the efforts to solve these problems can be traced through a representative list of prior art patents which illustrate both the difficulty in solving the problems and the present lack of a solution to the problems.

An early effort to provide an analog gauge with a warning device is disclosed in U.S. Pat. No. 4,536,756, which was issued to DePasquale, et al., as recently as 1985 and disclosed a pressure indicator and alarm for gas cylinders. That device requires a pin to be inserted through the cover of the gauge to contact the dial indicator to complete an electrical circuit. Unless the pin would bend out of the way, which is not disclosed, it cannot serve as a low pressure warning but only as an empty tank warning because the dial indicator or pointer would not otherwise be able to move past the point at which the electrical connection is established. A more sophisticated arrangement of a pressure gauge with a needle actuated electrical alarm is disclosed in U.S. Pat. No. 4,906,977 issued to Huey-Jeng more recently in 1990, but it still does not address the problems solved by the present invention.

In 1986, U.S. Pat. No. 4,613,851 was issued to Hines which disclosed a remote pressure indicating means. The indicator needle on the dial carried a permanent magnet which changed the state of reed switches to indicate different pressure levels. While it would appear that the device should function satisfactorily, it is too large, mechanically complicated, and expensive, for integration into a small dive computer and pressure gauge combination unit.

In 1989, the first combination low pressure warning device for SCUBA divers was disclosed in U.S. Pat. No. 4,800,373, issued to Mayz. It provides an audible warning as well as a visual indicator. The device uses a pressure switch in the air line to actuate the alarms and provide specialized visual indicators. This is a very expensive mechanism, but it does provide additional warnings to the critical marks or readings on a gauge. The present invention utilizes analog gauges and dive computers which have been modified to more economically provide the audible signal warning device of Mayz. Mayz does not teach a combined dive computer-low air pressure warning device as does the present invention. It therefore cannot be used to give a warning for entry into a decompression zone.

In 1992, U.S. Pat. No. 5,121,109 was issued to Murphy, Jr., et al., for an adjustable set point signaling gauge which discloses a more sophisticated mechanism for providing an electronic switch for an analog gauge. A magnet carried by the dial indicator magnetically actuates switch elements mounted at selected locations on the dial face. It is unknown whether this arrangement would work satisfactorily for a dive computer. The present invention is mechanically simpler, less expensive, and more reliable.

In 1993, U.S. Pat. No. 5,191,317 issued to Toth, et al., for a low air warning system for SCUBA divers which is particularly directed to the same problems solved by the present invention. The Toth device uses an electromagnetic transmitter positioned near the supply air tank and a corresponding electromagnetic receiver positioned on the diver's mask. This arrangement attempts to solve the problem of giving a warning to the diver apart from the air pressure gauge pointer traversing a critical mark on the gauge dial face. The low air pressure warning is a switch integrated into the air pressure line which activates the transmitter to send a visual signal to the mask. Applicant's invention provides a simpler and different warning device. Instead of a visual signal which can be lost in the confusion of the restricted view out of the mask, the present invention gives an audible warning which underwater has no other interfering sound to overcome.

In 1994, U.S. Pat. No. 5,357,242 issued to Morgano, et al., for an air pressure gauge with self-contained adjustable alarms. The device was specifically designed for diver air tank pressure monitoring and providing a warning device in addition to the gauge dial markings. While the device is designed to effect the same results as the as the present invention, it requires a mechanical connection between a shadow dial pointer and electrical contacts corresponding to the critical pressure points on the gauge dial. Mechanical electrical contacts are subject to frequent failure from several different causes, and the design of the present invention is specifically intended to overcome the problems associated therewith.

A sophisticated mechanism for providing a warning device integrated into a pressure gauge is disclosed in U.S. Pat. No. 5,051,729 issued in 1991 to Gray. That device is a pressure responsive encoder which utilizes light emitting diodes as a light source to create light signals which are transmitted by fiber-optic cables and detected by photo transistors. The light signals are reflected by an encoded rotatable disk to signal the selected pressure states of the gauge. The present invention utilizes an improved variation of the mechanical structure of this device with an improved and simplified electronic circuit to provide the results of the Mayz '373 patent.

SUMMARY OF THE INVENTION

The present invention is comprised of a signal generator for analog gauges having a dial pointer mounted on a shaft disposed perpendicular to and extending through the dial face of the gauge. The signal generator includes an infrared switch mounted internally in the gauge in a fixed position, and a disk mounted beneath the dial face on the shaft supporting the pointer whereby the disk rotates synchronously with the pointer. The disk is disposed in the path of the infrared switch IR light sender and receiver, and has one or more openings formed therein whereby the switch alternates between an on or off condition depending upon whether the IR light from the switch is reflected by the disk or passes beyond the disk through one of the openings formed in the disk. The openings are positioned to correspond to preselected pressure readings of the gauge. The signal generator also includes a sensor means for reading the on or off condition of the switch, and a means for actuating an audible and visual alarm by the sensor means in response to a predetermined condition of the switch.

The present invention also is comprised of a case for containing first and second electrically interconnected elements and at least one aural signal generating device, the first element including an analog air pressure gauge having at least one electronic IR switch which when activated indicates a preselected low pressure state, the second element including a battery-powered sensor, the sensor being responsive to activation of the IR switch and powering the signal generating devices when the sensor determines the switch has been activated.

The present invention also includes a method of providing a low air tank pressure audible warning for SCUBA divers. The steps comprising: providing an analog pressure gauge including an IR switch which is activated by a preselected pressure reading on the dial face of the gauge; providing an electrically powered signaling device; providing a battery-powered sensor of which is responsive to activation of the switch; and powering the signaling device with power from the sensor batteries when the sensor determines the IR switch has been activated.

OBJECTS OF THE INVENTION

It is therefore an important object of the present invention to provide a combined audible warning for SCUBA divers for low air tank pressure and for entry into a decompression zone.

It is another object of the present invention to provide an improvement for a standard analog air pressure gauge which activates an electronic switch at a preselected pressure indication.

It is a further object of the present invention to provide a dive computer and pressure gauge combination which activates signaling devices at a preselected indication on the pressure gauge or entry into a decompression zone.

It is still another object of the present invention to provide an aural warning when a SCUBA diver enters a decompression zone.

And it is yet a further object of the present invention to provide a new and novel electronic switch for analog gauges.

Other objects and advantages of the present invention will become apparent when the method and apparatus of the present invention are considered in conjunction with the accompanying drawings.

DESCRIPTION OF THE PREFERRED EMBODIMENT

Figure 1:
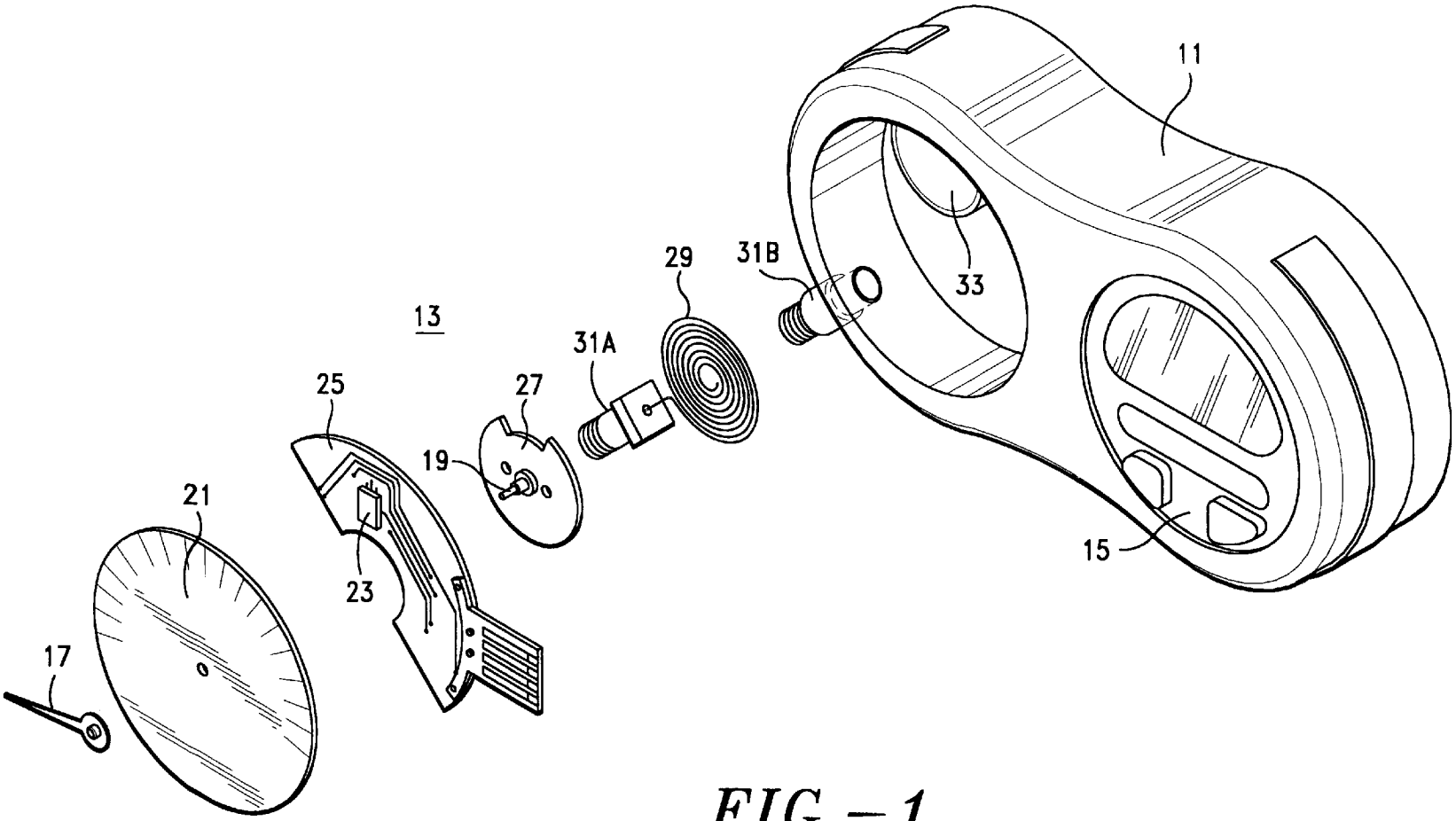
FIG. 1 is an exploded perspective view of the SCUBA air dive computer of the present invention.

Reference is made to the drawings for a description of the preferred embodiment of the present invention wherein like reference numbers represent like elements on corresponding views. FIG. 1 is an exploded perspective view of a preferred embodiment of the present invention in the form of a dive computer. It is essentially a combination of three separate elements which are mounted in an integral case 11 and are interconnected electronically to operate synergistically to perform different functions. The exploded view portion of FIG. 1 shows the essential elements of an analog air pressure gauge 13 while the other side of the case containers a dive computer 15.

The first element of the combination is a signal generator for typical analog gauges having a dial pointer 17 mounted on a shaft 19 disposed perpendicular to and extending through the dial face 21 of the gauge. In the particular application of the present invention, it is a modified analog air pressure gauge for monitoring the pressure in a SCUBA diver's air tank. An analog gauge is accurate and dependable. It is especially legible and comprehensible under stressful conditions such as underwater or in a hostile environment. The gauge of the invention is provided with one or more switches which are activated at preselected tank pressures to actuate low and other desired pressure status warnings.

A second element of the combination is a battery-powered sensor which is responsive to the state of the switches in the pressure gauge while the third element of the combination are the signaling devices which give warnings when they are electrically powered by the batteries of the sensor.

This combination of three elements comprise an integrated SCUBA air monitor and dive computer. The case 11 is provided for containing the first and second elements of the invention and at least one aural signal generating device; all of which are electrically interconnected. The second element, the battery-powered sensor, is an integral part of a dive computer having logic programmed thereinto for identifying the condition or state of the switches on the pressure gauge 13 and for activating the alarms by providing power thereto from its battery when the pressure gauge indicates a preselected pressure state.

At least one infrared (IR) switch 23 is mounted internally in the gauge 13 in a fixed position. IR switches are minute in size and alternate their state or condition between off and on by sending an IR beam of light which, if reflected and the reflection received, changes state. The switch is fixed to the gauge case on a circuit board 25 and is aimed to send its IR beam toward a moving mirror which under certain conditions moves out of the path of the IR beam changing the state. Alternatively, the switch could be mounted to move with the mirror being fixed in position and having nonreflecting surfaces or holes located to cause the switch to change state.

The signal generator of the present invention can be used with any of the standard analog gauges of the type which have a dial pointer 17 mounted on a shaft 19 disposed perpendicular to and extending through the dial face 21 of the gauge 13 inside the gauge case 11 under the faceplate (not shown) which is the predominant form of an analog gauge. In the invention, a disk 27 is mounted beneath the dial face 21 on the shaft which supports the dial indicator or pointer whereby the disk rotates synchronously with the pointer. The disk comprises the mirror which is disposed in the path of the infrared switch IR light beam transmitter 28 and receiver 30. The dial pointer and the mirror disk rotate in concert with expansion of the bourdon tube 29 which is connected to the air pressure inlet 31A and 31B.

Figure 2A:
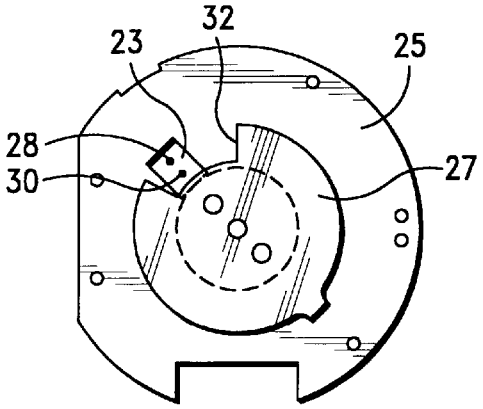
FIG. 2A is a top plan view of the circuit board and mirror disk with the IR switch in a first state.
Figure 2B:
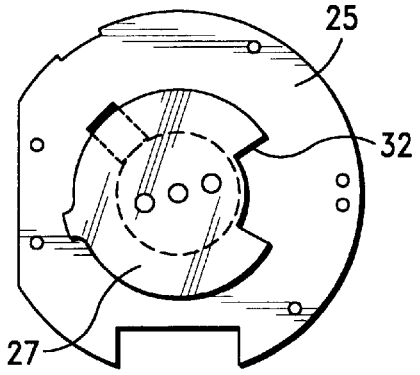
FIG. 2B is a top plan view of the circuit board and mirror disk with the IR switch in an opposite state.

The disk has one or more openings formed therein whereby the switch alternates between an on or off condition or state depending upon whether the IR beam from the switch is reflected by the disk or passes beyond the disk through one of the openings formed in the disk. The openings are positioned to correspond to preselected pressure readings of the gauge. Reference is made to FIGS. 2A and 2B. In the preferred embodiment of the invention, the openings in the disk comprise cutouts in the edge or periphery of the disk. FIG. 2A shows the IR transmitter/receiver uncovered by the disk, so the switch is in a first condition—on or off; and FIG. 2B shows the IR switch covered whereby the light beam is reflected and the switch in the opposite state. The signal generator can include a multiple of infrared switches mounted in the gauge with a multiple of openings formed in the periphery of the disk corresponding to a multiple of preselected pressure readings on the gauge.

In those situations where for some reason the tolerances for maintaining the relationship of the mirror surface of the disk to the IR unit is a problem, separate IR beam transmitters and receivers can be utilized, disposed in fixed locations in the gauge case on opposite sides of the disk. If the IR beam passes through the disk whereby it is not interrupted by the disk through a hole in the disk or through a gap in the edge of the disk, and is detected by the receiving unit, the switch is either on or off as previously determined. Movement of the disk to interrupt the beam changes the state of the switch.

Sensor means are provided for reading the on or off condition of the switch, and means are provided for actuating audible and visual alarms in response to a predetermined condition of the switch: either on or off. The sensor means for reading the electrical state of the switch requires supplying electricity to the switch whereby a change of state is identified. In the preferred embodiment of the invention, the change of state of the switch is identified by logic programmed into a battery powered dive computer 15. Likewise, the means for actuating alarms in response to change of state of the condition of the switch 23 is effected by the computer recognizing the change of state and in response thereto supplying electricity from its batteries to the alarms to generate an audible and visual signal.

The dive computer has a pressure depth transducer formed integral thereto, and the logic of the computer is programmed to identify when the computer is at depth from a signal from the depth transducer. The logic of the computer is further programmed to send power to the signal generators when it identifies a low pressure signal from the air pressure gauge when the computer is at depth.

Two types of alarms are contemplated by the invention. The first and most important is an audible alarm which is usually not masked underwater or in hostile environments by extraneous noise. In the preferred embodiment, a pietzo electric beeper 33 is employed due to its low power requirements and high sound output.

The computer logic can also be programmed to activate the backlighting of the air pressure gauge and the computer dial face display to flash concurrently with the audible signal as a second or alternative warning alarm when the logic identifies a critical condition. Variable patterns and colors of flashing can also be included such as one of increasing speed of repetition as a critical condition intensifies. One switch or more buttons on the computer can be programmed for test modes of the audible and visual alarms, the battery condition, and backlighting activation, as well as functioning as the computer controls.

The computer logic is also programmed to activate the signal generators when the computer recognizes a transition into a decompression zone. As with a low air condition being a critical state during a dive, entering a decompression zone is likewise a critical state during a dive, and a warning in addition to a gauge reading is very desirable. For that reason, the present invention can serve dual purposes. The aural signal generator warning for the low air pressure warning can also be activated when the computer logic indicates entry into a decompression zone. Different audible signals can be generated either in tone, sequence, intensity, or pattern by a combination of the logic in the computer and, if necessary, the use of a multiple of different signal generators.

Backlighting for the dial faces of both of the units, the air pressure gauge and the computer, is powered by the batteries of the computer so that a separate power source for either the aural signal generator or the backlighting of the gauges is not required. Utilizing the batteries of the computer for backlighting the gauges and powering the aural alarm permits compactness and saves considerable weight since batteries are inherently heavy relative to the rest of the equipment of the invention. Either gauge backlighting can serve as the visual alarm.

The invention also includes a method of providing a low air tank pressure audible warning for SCUBA divers. The steps comprise providing an analog pressure gauge including an IR switch which is activated by a preselected pressure reading on the dial face of the gauge; providing an electrically powered aural signaling device and a battery-powered sensor of which is responsive to activation of the switch in the gauge. The signaling device is powered from the sensor batteries when the sensor determines the IR switch has been activated.

The method of the invention also includes the function wherein the gauge switch is an IR activated mechanism which is controlled by a mirror surface which is mechanically interlocked to the dial indicator of the gauge to move synchronously therewith whereby the positioning of the mirror can be coordinated with the determination of the preselected pressure reading. It also includes the function wherein the sensor is a SCUBA diver computer having logic programmed therein to sense the state of the switch and activate its batteries to power the signaling device when the computer determines that the state of the switch has been changed.

All of these functions provide an integrated warning device that monitors very different and critical dive conditions for a SCUBA diver and gives supplemental warnings that supersede the normal warnings that appear on a SCUBA diver's dive gauges.

Thus, it will be apparent from the foregoing description of the invention in its preferred form that it will fulfill all the objects and advantages attributable thereto. While it is illustrated and described in considerable detail herein, the invention is not to be limited to such details as have been set forth except as may be necessitated by the appended claims.

What is claimed is:

1. A signal generator for analog gauges having a dial pointer mounted on a shaft disposed perpendicular to and extending through the dial face of the gauge, said signal generator comprising an infrared ON/OFF switch mounted internally in said gauge in a fixed position, a disk mounted beneath said dial face on said shaft supporting said pointer whereby said disk rotates synchronously with said pointer, said disk being disposed in the path of said switch IR light beam transmitter and receiver, said disk having one or more openings formed therein whereby said switch alternates between an on or off condition depending upon whether said IR light from said switch is reflected by said disk or passes beyond said disk through one of said openings formed in said disk, said openings being positioned to correspond to preselected pressure readings of said gauge, sensor means for reading said on or off condition of said switch, and means for actuating audible/visual alarms by said sensor means in response to a predetermined condition of said switch.

2. The signal generator of claim 1 including a multiple of infrared on/off switches mounted in said gauge and a multiple of openings formed in said disk corresponding to various preselected pressure readings on said gauge.

3. The signal generator of claim 1 wherein said IR light beam transmitter and receiver are combined in one unit and said switch is activated by said IR light beam being reflected by said disk to said receiver.

4. The signal generator of claim 1 wherein said IR light beam transmitter and receiver are separate units disposed on opposite sides of said disk and said switch is activated by said IR light passing through or beyond said disk to said receiver.

5. The signal generator of claim 1 wherein said openings are formed by notches located in the periphery of said disk.

6. A SCUBA air dive computer comprising a case for containing first and second electrically interconnected elements and at least one signal generating device, said first element including an analog air pressure gauge having at least one electronic infrared on/off switch which when activated indicates a preselected low pressure state, said second element including a battery-powered sensor, said sensor being responsive to activation of said switch and powering said signal generating device when said sensor determines said switch has been activated.

7. The dive computer of claim 6 wherein said signal generating device is an aural signal generator.

8. The dive computer of claim 6 wherein said signal generating device is a visual signal generator.

9. The signal generator of claim 8 wherein said air pressure gauge is backlighted and said sensor activates said backlight.

10. The dive computer of claim 6 wherein said sensor is a battery powered computer having logic programmed thereinto for identifying the state of said switch of said pressure gauge, said computer activating said signal generating device by providing power thereto from its battery when the state of said switch indicates a preselected low pressure status.

11. The dive computer of claim 10 including a pressure depth transducer formed integral thereto and electrically connected to said computer, said logic of said computer programmed to identify when said computer is at depth from signals from said depth transducer, and said logic of said computer programmed to identify a low pressure signal from said air pressure gauge when said computer is at depth and to send electrical power to said signal generating device.

12. The dive computer of claim 6 wherein backlighting for both of said air pressure gauge and said computer is powered by said battery-powered computer.

13. The method of providing a low air tank pressure audible warning for SCUBA divers, the steps comprising, providing an analog pressure gauge including an IR switch which is activated by a preselected pressure reading on the dial face of said gauge, providing an electrically powered signaling device, providing a battery-powered sensor of which is responsive to activation said switch, and powering said signaling device with power from said sensor batteries when said sensor determines said IR switch has been activated.

14. The method of claim 13 wherein said switch is an IR activated mechanism which is controlled by a mirror surface which is mechanically interlocked to the dial indicator of said gauge to move synchronously therewith whereby the positioning of said mirror can be coordinated with the determination of said preselected pressure reading.

15. The method of claim 14 wherein said sensor is a SCUBA diver computer having logic programmed therein to sense the state of said switch and activate its batteries to power said signaling device when said computer determines that the state of said switch has been changed.

* * * * *